US010822163B2

(12) United States Patent
Ptochos et al.

(10) Patent No.: US 10,822,163 B2
(45) Date of Patent: Nov. 3, 2020

(54) LIGHTWEIGHT METALLIC SHIPPING CONTAINER

(71) Applicant: iPEOPLE Limited, London (GB)

(72) Inventors: Evangelos P. Ptochos, Messinias (GR); Dimitrios P. Ptochos, Messinias (GR); Sotirios P. Ptochos, Messinias (GR); Milan M. Sunaric, Aitoloakarnanias (GR)

(73) Assignee: IPEOPLE LIMITED, London (GB)

( * ) Notice: Subject to any disclaimer, the term of this patent is extended or adjusted under 35 U.S.C. 154(b) by 68 days.

(21) Appl. No.: 15/830,323

(22) Filed: Dec. 4, 2017

(65) Prior Publication Data

US 2019/0168959 A1 Jun. 6, 2019

(51) Int. Cl.

| | |
|---|---|
| ***B65D 90/02*** | (2019.01) |
| ***B65D 90/00*** | (2006.01) |
| ***B65D 90/08*** | (2006.01) |

(52) U.S. Cl.

CPC ..... *B65D 90/027* (2013.01); *B65D 90/008* (2013.01); *B65D 90/022* (2013.01); *B65D 90/08* (2013.01)

(58) Field of Classification Search

CPC .. B65D 90/027; B65D 90/008; B65D 90/022; B65D 90/08

USPC ..... 220/1.5

See application file for complete search history.

(56) References Cited

U.S. PATENT DOCUMENTS

| | | | | |
|---|---|---|---|---|
| 3,187,853 | A * | 6/1965 | Glaser | B62D 25/2054 105/422 |
| 3,301,582 | A * | 1/1967 | Linecker | A47B 47/027 403/230 |
| 3,456,829 | A | 7/1969 | Glassmeyer | |
| 3,895,152 | A * | 7/1975 | Carlson | B65D 90/06 428/116 |
| 4,325,488 | A | 4/1982 | Ketner | |
| 5,348,176 | A * | 9/1994 | Yurgevich | B65D 88/121 220/1.5 |
| 5,450,977 | A * | 9/1995 | Moe | B65D 88/022 220/1.5 |
| 5,741,042 | A | 4/1998 | Livingston et al. | |

(Continued)

OTHER PUBLICATIONS

Steinecker, "Technical Specification for Steel Dry Cargo Container," www.steinecker-container.de, 2012.

*Primary Examiner* — Anthony D Stashick
*Assistant Examiner* — James M Van Buskirk
(74) *Attorney, Agent, or Firm* — Steven M. Greenberg, Esq.; Shutts & Bowen LLP

(57) ABSTRACT

A lightweight shipping container includes two parallel side walls each having a top rail and secured on the opposite side to bottom rails of a floor frame, both bottom rails being coupled to one another by a floor, which is secured to and resting on a multiplicity of cross-beam members of the floor frame. A front end assembly is secured to one end of the top and bottom side rails and a door end assembly opposite the front end assembly is secured to an opposite end of the top and bottom side rails. The container further includes a roof secured to respective ones of the top rails of each of the two side walls. The floor includes a metallic cellular sandwich panel formed by a frame defining an interior portion of the panel and including a metallic cellular core of a multiplicity of metallic polygonal cells, and a skin covering both the frame and the metallic cellular core.

13 Claims, 7 Drawing Sheets

(56) References Cited

U.S. PATENT DOCUMENTS

| | | | | |
|---|---|---|---|---|
| 6,061,993 | A | 5/2000 | Bendixen et al. | |
| 7,185,779 | B2 * | 3/2007 | Payne | B65D 88/121 220/1.5 |
| 2007/0238166 | A1 | 10/2007 | Mcnelly | |
| 2009/0184112 | A1 * | 7/2009 | Nielsen | B65D 88/121 220/1.5 |
| 2010/0233503 | A1 | 9/2010 | Zachman et al. | |
| 2011/0247296 | A1 * | 10/2011 | Stal | E04C 3/065 52/838 |
| 2014/0251988 | A1 | 9/2014 | Amato et al. | |

* cited by examiner

LIGHTWEIGHT METALLIC SHIPPING CONTAINER

BACKGROUND OF THE INVENTION

Field of the Invention

The present invention relates to the field of shipping containers.

Description of the Related Art

Since first introduced nearly seven decades ago, standardized shipping containers have revolutionized cargo transport. A shipping container is a reusable transport and storage unit that serves to move products and materials between multiple locations. A typical container consists of a rectangular, closed box design with doors on one end, a corrugated weathering steel frame, and a wooden floor. Although approximately ninety percent of the world's shipping containers are either twenty feet or forty feet in length, the lengths of containers around the world vary from eight to sixty feet. Regardless of length, standard containers are eight feet wide by eight and one-half feet high, while "hi-cube" units measure nine and one-half feet high, and "half-height" units measure four and one quarter feet high. The capacity of a shipping container is commonly expressed in twenty-foot equivalent units (TEU), which represents the amount of cargo that can fit in one twenty foot container. Costs for transport are calculated in TEU. Two TEU is equivalent to one forty-foot equivalent unit (FEU).

Shipping containers are useful because of their ability to be easily transferred between rail, truck, and ship without having to be unloaded during the process. Shipping containers can be transported by truck on a trailer. When transported by rail, shipping containers are carried on flatcars or well cars. The containers can be easily stacked on top of one another, depending on particular rail system restrictions. Containers can also be transported by ship. Ships provide the highest capacity transport of any mode of transportation; some container ships can carry nearly twenty-thousand TEU. This high capacity can be achieved due to the large amount of area reserved for cargo aboard the ship and the stacking of containers on top of one another, typically up to seven units high. Ports and cargo terminals are generally configured to handle shipping container logistics using various handling equipment. Examples of such equipment include forklifts, gantry cranes, and reach stackers.

A shipping container consists of some key structural components that all transfer weight and racking forces. The first component is the roof. A shipping container roof is typically made of weathering steel sheets with corrugated profiles for strength and rigidity. The next component, the side wall panels, are made from the same material as the roof. Another component of a shipping container is the floor and cross members. A container floor is typically made of laminated marine plywood. The cross members are a series of transverse beams that provide for an integral part of the floor frame support. The floor frame may optionally include the gooseneck tunnel, which facilitates for the container's truck transport. The container floor rests on the cross members. An additional component is the top and bottom side rails. The side rails are longitudinal structure members located on the top and bottom of the container that act as a frame for the container's body.

The next key component is the corner post and corner castings. The corner post is a vertical frame component made of high tensile steel that works with the rails to support the container's structure. The corner castings are fittings located on each corner of the container that provide means for handling, lifting, or stacking the container. The top and bottom beams of the front end and the door end assemblies complete the container's frame. All the components of the frame are secured over the corner castings. The corrugated front end wall panels are constructed of the same material as the side wall. The last key component includes the doors. The doors of a shipping container can be made of ply-metal, corrugated metal, or combinations with fiberglass. The doors are hinged and open at least one-hundred eighty degrees. Plastic or rubber lined door gaskets act as a seal against liquid entry.

The construction of a shipping container also is a standardized process which begins with the unrolling of a large roll of steel and the cutting of the roll of steel into several sheets of appropriate size. The sheets are then corrugated to provide rigidity and extra strength. Next, the sheets are welded together into wall panels. Square tubing top side rails are then welded on the top of each wall to create side wall assembly. Thereafter, floor cross-members, gooseneck tunnel and bottom side rails are welded together to create the frame of the floor. Doors, door end posts, door end beams and door end corner castings are welded together to create the door end assembly. Similarly, front end walls, front end corner posts, front end beams and front end corner castings are welded together to create the front end assembly. Once these components are assembled, the door end assembly and the front end assembly are installed on the floor frame before the sidewall assemblies are installed. At this point sidewall assemblies are welded to the corner posts, door end assembly and front end assembly and the bottom side rails of the floor frame. Next, the roof panel is assembled and welded. In this phase an anti-corrosion primer is applied all over the container structure. Wooden plates are then prepared for flooring. Once the wood is assembled and installed, the complete interior of the container is covered with liquid sealant. The bottom surface of the container floor as well as the complete floor frame is sealed with bituminous for water tightness. At the end rubber or plastic gasket seals are installed on doors to provide watertight insulation. This completes the construction process of a shipping container.

BRIEF SUMMARY OF THE INVENTION

Applicants have invented a lightweight metallic container that is lighter than shipping containers of the known art. In accordance with an embodiment of the invention, a lightweight shipping container includes two parallel elongated side walls each with a corresponding top and bottom rail, and coupled to one another by a floor secured and resting on a floor frame, which includes a multiplicity of cross-beam members joining the bottom rail of each of the two side walls. The container includes a front end assembly secured to one end of the top and bottom side rails of each of the two side walls over respective corner castings and a door end assembly opposite the front end assembly and secured to an opposite end of the top and bottom side rails of each of the two side walls over respective corner castings. The container further includes a roof secured to respective top rails of each of the two side walls. Of note, the floor includes at least one metallic cellular sandwich panel formed by a frame defining an interior portion of the panel, the interior portion including a metallic cellular core of a multiplicity of metallic polygonal cells, and a skin covering both the frame and the metallic cellular core.

In one aspect of the embodiment, the side walls each includes a multiplicity of vertically continuous steel corrugated panels of two or more different thicknesses arranged in multiple alternating sequences of panels of greater thickness and panels of lesser thickness. For instance, the two different thicknesses may be 1.6 mm and 2.0 mm. Alternatively, the side walls may include a multiplicity of horizontally continuous steel corrugated panels of a single uniform thickness of less than or equal to 1.6 mm in thickness. In another aspect of the embodiment, the front end panel includes a multiplicity of vertically continuous steel corrugated panels of two different thicknesses arranged in multiple alternating sequences of panels of greater thickness and panels of lesser thickness. Again, the two different thicknesses may include 1.6 mm and 2.0 mm. In yet another aspect of the embodiment, the roof includes a multiplicity of horizontally continuous steel corrugated panels of two different thicknesses arranged in multiple alternating sequences of panels of greater thickness and panels of lesser thickness, such that the two different thicknesses may be 1.6 mm and 2.0 mm. Alternatively, the roof may include a multiplicity of horizontally continuous steel corrugated panels of a single uniform thickness of less than or equal to 1.6 mm in thickness.

In even yet another aspect of the embodiment, a roof panel stiffener assembly may be provided supporting the roof and which is coupled to a top beam of the door end assembly and extends longitudinally to a top beam of the front end assembly. In this regard, the roof panel stiffener assembly may include two symmetrical corrugated L stiffeners joined to one another. As well, two additional L stiffeners may be disposed at opposite sides of the roof panel stiffener assembly and may extend longitudinally from the top beam of the door end assembly to the top beam of the front end assembly. Yet further, the bottom rail of each side wall may include a multiplicity of stiffening ribs welded to the bottom rail. Finally, the door end assembly may include two doors each with a frame defining an interior portion of the door that includes a metallic cellular core of a multiplicity of polygonal cells, and an aluminum skin covering both the frame and the metallic cellular core.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the invention provide for a lightweight metallic container and a process for the fabrication thereof. A lightweight metallic container includes two parallel elongated side walls, each with a top rail at one side and secured on an opposite side to a bottom rail of a floor frame, both bottom rails being coupled to one another by a floor, which is secured to and resting on a multiplicity of cross-beam members of the floor frame. The side walls additionally are coupled to one another by a front end assembly secured to one end of the top and bottom rails of each of the two side walls over respective corner castings, and also by a door end assembly opposite the front end assembly and secured to an opposite end of the top and bottom rails of each of the two side walls over respective corner castings, and by a roof secured to respective top rails of each of the two side walls. Importantly, the floor includes at least one metallic cellular sandwich panel formed by a frame defining an interior portion of the panel, the interior portion including a metallic cellular core of a multiplicity of polygonal cells, and a skin covering both the frame and the metallic cellular core.

Figure 1:
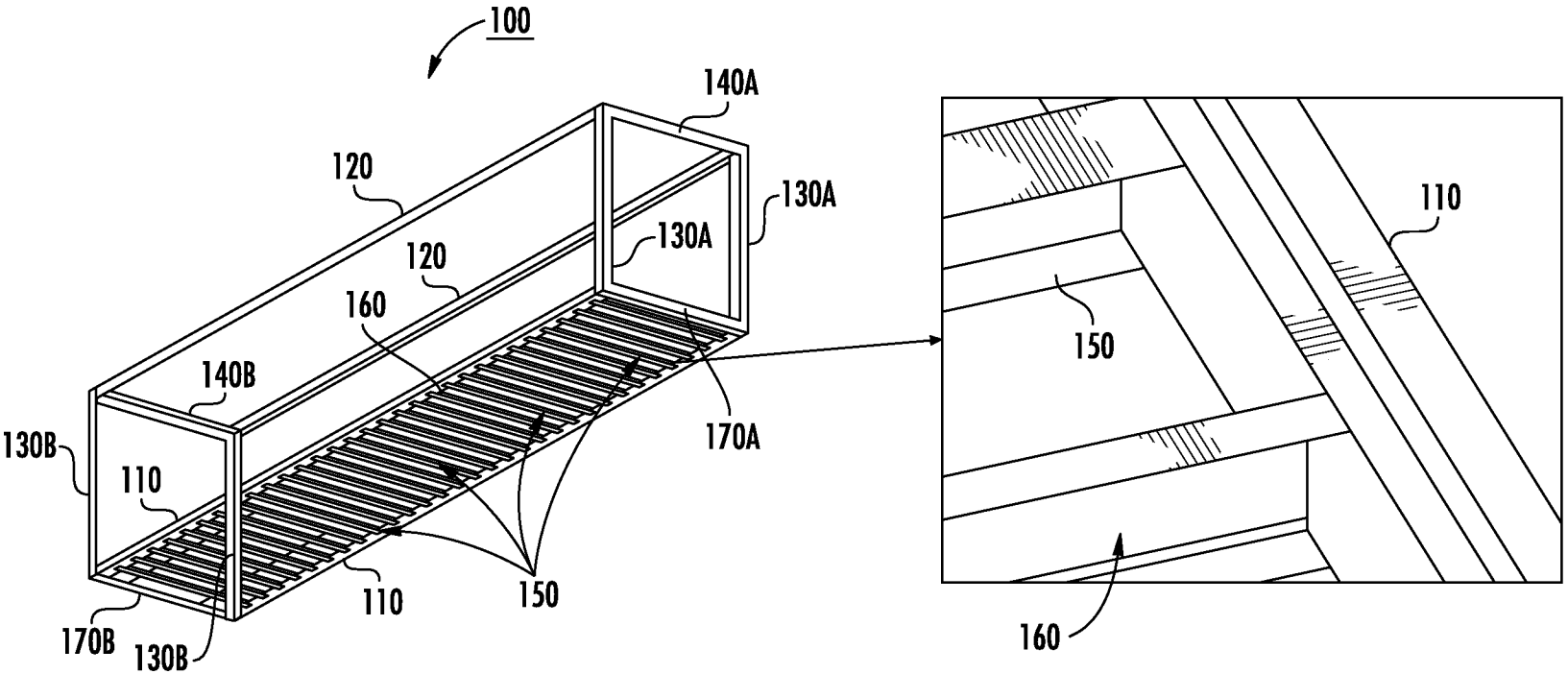
FIG. 1 is a perspective view of a lightweight metallic container with an exploded portion illustrating one cross member beam secured to a bottom rail of a side wall of the container.

In further illustration, FIG. 1 is a perspective view of a lightweight metallic container with an exploded portion illustrating one cross member beam secured to a bottom rail of a side wall of the container. As shown in FIG. 1, a lightweight shipping container 100 includes two parallel bottom rails 110 and two parallel top rails 120, each of the bottom rails 110 being secured to a corresponding one of the top rails 120 over respective corner castings (not shown) by a door end post 130A and a front end post 130B. As well, the top rails 120 are secured to one another by door end beam 140A and front end beam 140B. As will be recognized by one of skill in the art, each of the top rails 120 when secured to a corresponding one of the bottom rails 110 by the door end post 130A and the front end post 130B defines a frame for a corresponding elongated side wall (not shown). As well, the door end posts 130A and the door end beams 140A and 170A define a door end frame (not shown), while the front end posts 130B and the front end beams 140B and 170B define a front end frame (not shown).

Figure 3:
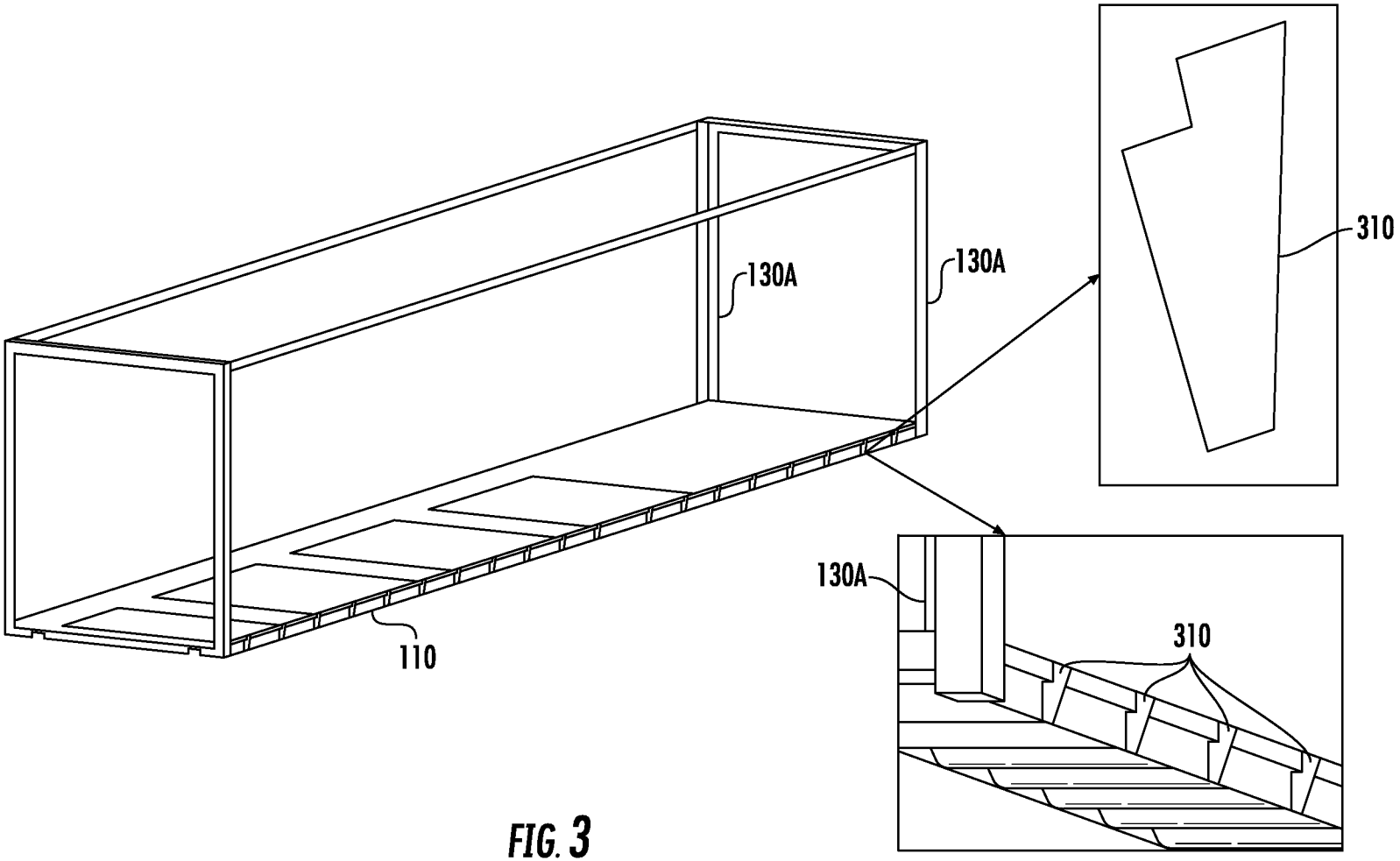
FIG. 3 is a perspective view of the lightweight metallic container of FIG. 1 with an exploded portion illustrating placement of stiffening ribs about the bottom rail.
Figure 7:
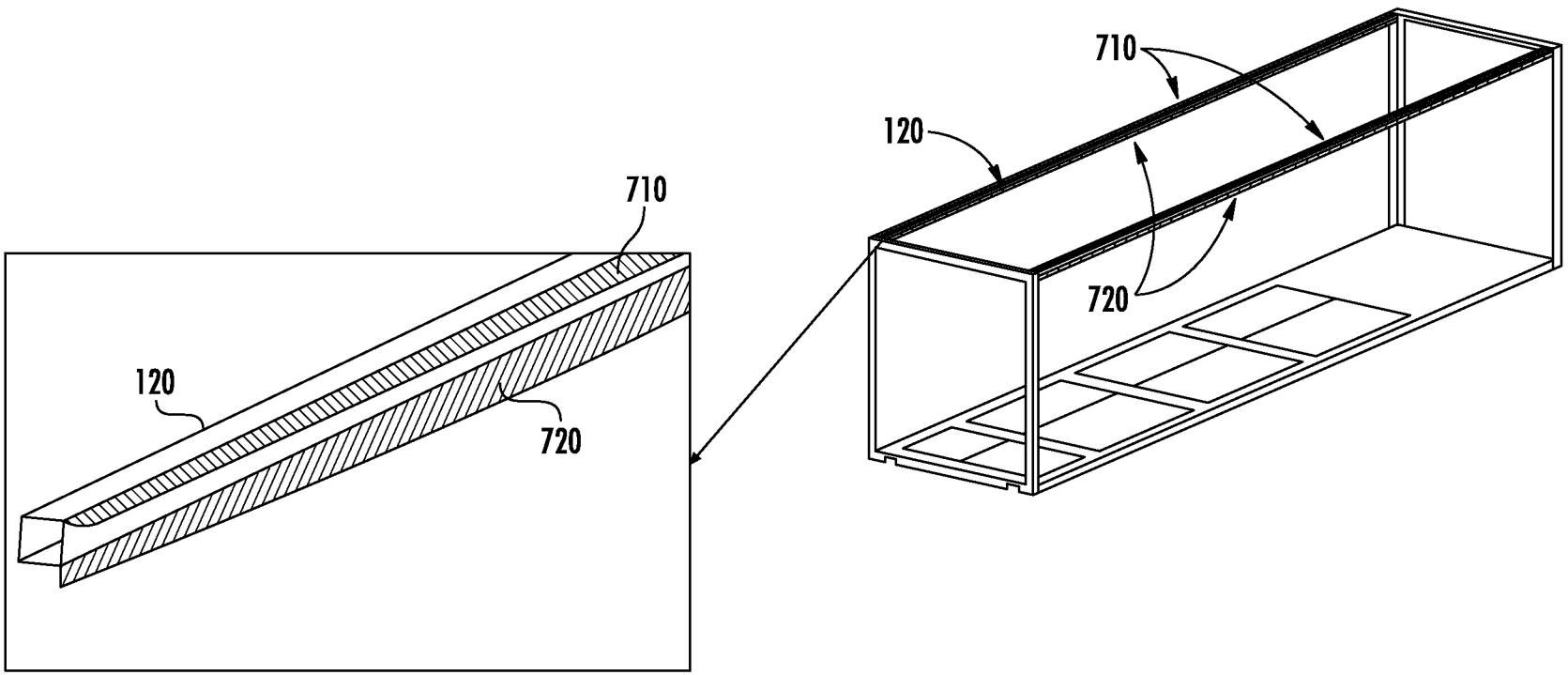

Of importance, the elongated side walls are coupled to one another by the floor secured and resting on the floor frame, which includes a multiplicity of cross-beam members 150, as well as smaller C-beam members 160 interspersed between the cross-beam members 150, all joining the bottom rail 110 of each of the two side walls. Optionally, stiffening ribs 310 may be dispersed along the bottom rails 110 and welded thereto as shown in FIG. 3. As well, in reference to FIG. 7, different stiffeners may be secured to the top rail 120 of each of the side panels in the roof plane and side wall plane, respectively, as shown in FIG. 7. In this regard, the stiffeners may include an inwardly extending horizontal metallic extension 710 of a top portion of the top rail 120 upon which a roof is placed, and also a downwardly extending metallic extension 720 outside of which one of the side walls is placed.

Figure 2:
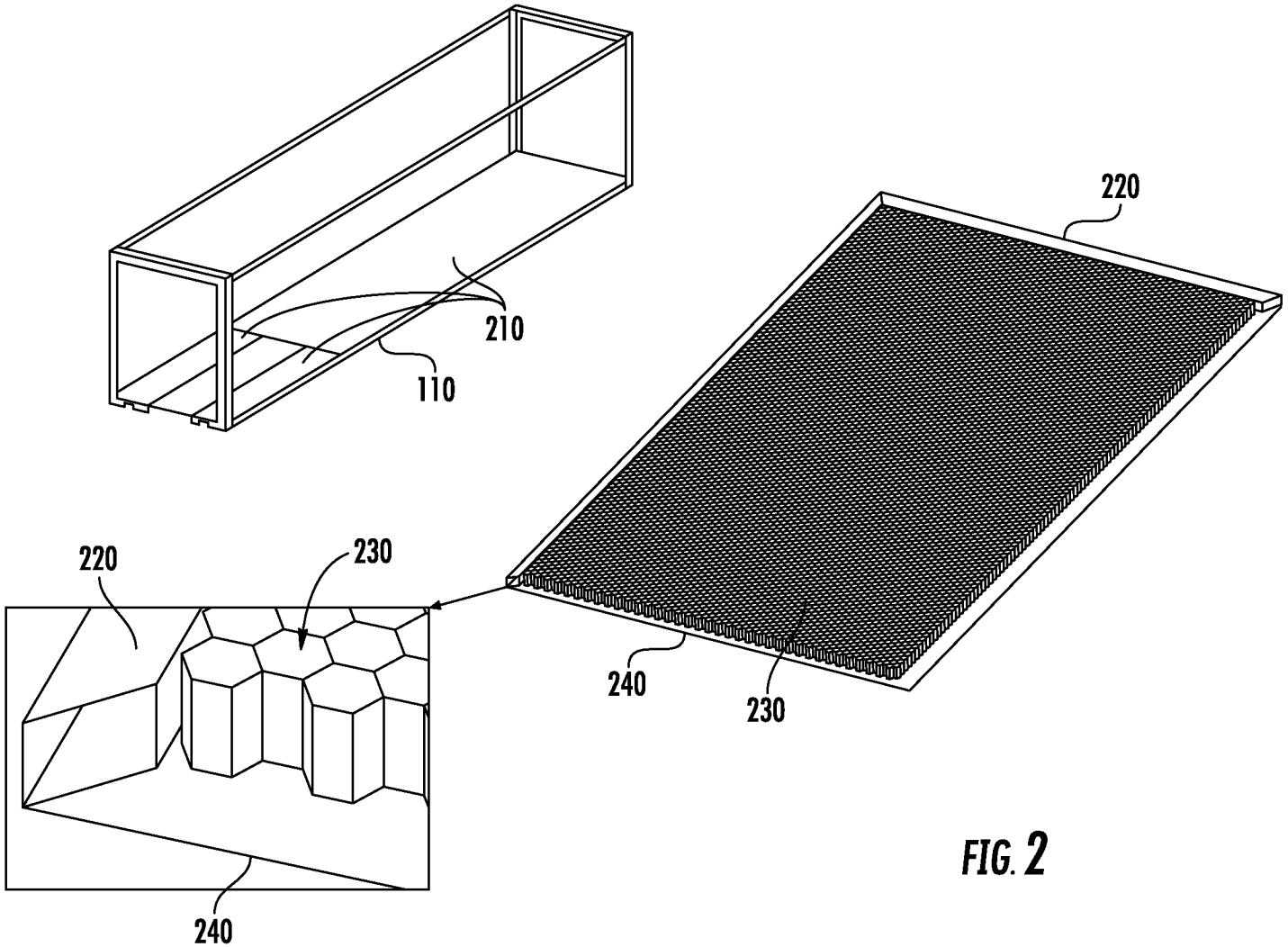
FIG. 2 is a perspective view of the lightweight metallic container of FIG. 1 with an exploded portion illustrating a floor of the container including at least one metallic cellular sandwich panel.

Notably, one or more metallic cellular sandwich panels (not shown) are then secured to a top surface of each of the cross-beam members 150 and C-beam members 160. In further illustration, FIG. 2 is a perspective view of the lightweight metallic container of FIG. 1 illustrating a floor 210 of the container accommodating a gooseneck tunnel adapted to mesh with a gooseneck on a dedicated container semi-trailer. The floor 210 includes at least one metallic cellular sandwich panel, as shown in the exploded portion of the FIG. 2. In this regard, the metallic cellular sandwich panel includes a frame 220 enveloping a metallic cellular core 230 laid and sandwiched between an aluminum skin 240 on opposite sides of the metallic cellular core 230. The metallic cellular core 230 includes a multiplicity of arranged hollow polygonal cells formed of a metal, such as aluminum for instance with a thickness of twenty-six millimeters. By utilizing the metallic cellular sandwich panel instead of wood panels, a lighter weight floor is provided that incorporates the strength provided by the metallic cellular sandwich structure without the weight of a solid material such as wood.

Figure 4A:
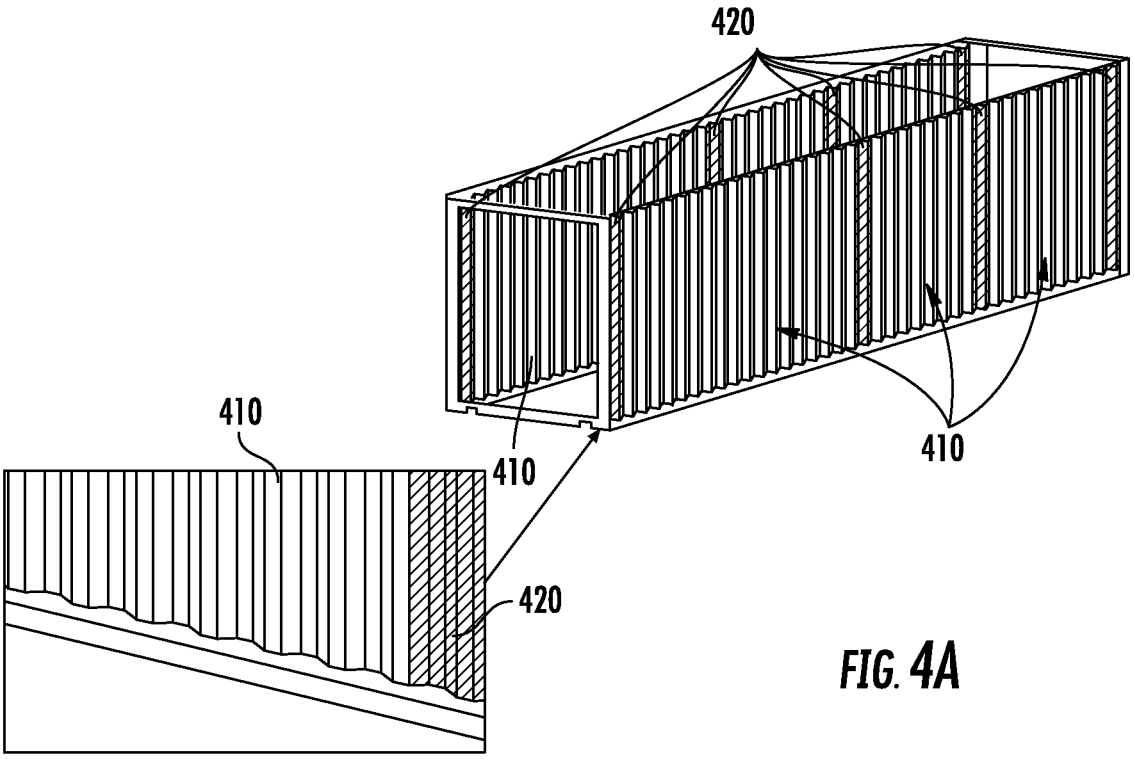
FIG. 4A is a perspective view of the lightweight metallic container of FIG. 1 with an exploded portion illustrating the side walls of the container.
Figure 4B:
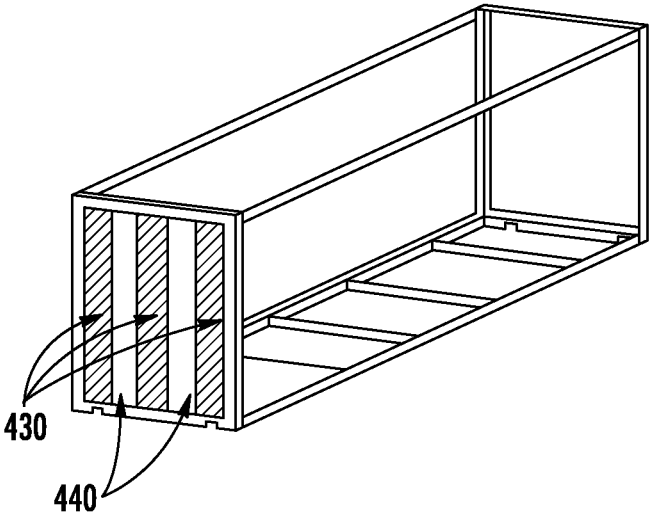
FIG. 4B is a perspective view of the lightweight metallic container of FIG. 1 detailing a front end panel of the container.

Referring now to FIG. 4A, a perspective view of the lightweight metallic container of FIG. 1 is shown with an exploded portion illustrating the side walls of the container 100 of FIG. 1. The side walls are formed by a multiplicity of vertically continuous steel corrugated panels 410, 420 of two different thicknesses arranged in multiple alternating sequences of panels 420 of greater thickness and panels 410 of lesser thickness. For instance, the two different thicknesses may be 1.6 mm and 2.0 mm. Referring to FIG. 4B, the front end assembly also may include a multiplicity of vertically continuous steel corrugated panels 430, 440 of two different thicknesses arranged in multiple alternating sequences of panels 430 of greater thickness and panels 440 of lesser thickness. Again, the two different thicknesses may include 1.6 mm and 2.0 mm.

Figures 5A, 5B:
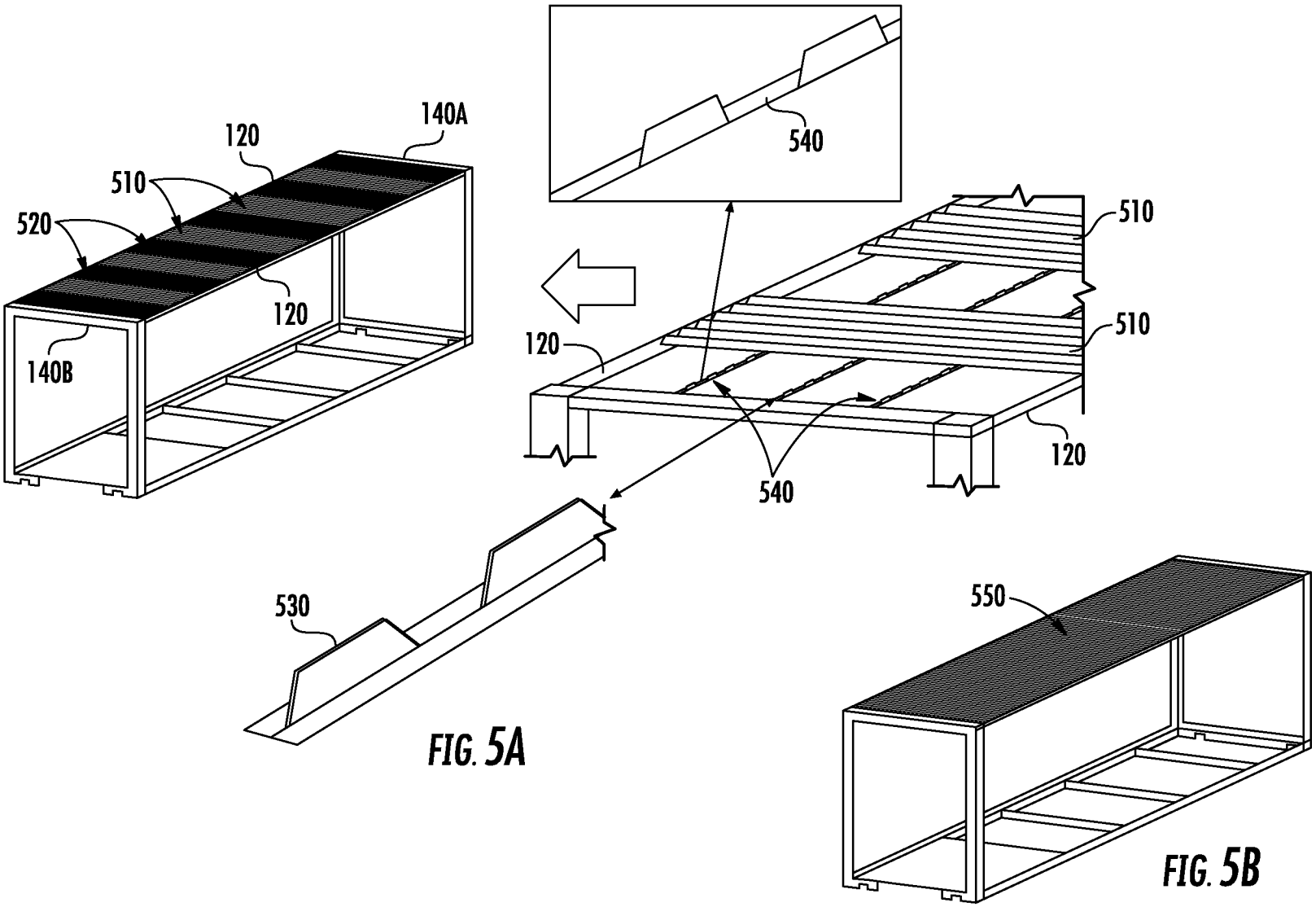
FIG. 5A is a perspective view of the lightweight metallic container of FIG. 1 with an exploded portion illustrating a roof of the container with a stiffener assembly.
FIG. 5B is a perspective view of the lightweight metallic container of FIG. 1 detailing the roof of the container.

Referring now to FIG. 5A, a perspective view of the lightweight metallic container of FIG. 1 is provided with an exploded portion illustrating a roof of the container 100 with a stiffener assembly. In this regard, the roof includes a multiplicity of horizontally continuous steel corrugated panels 510, 520 of two different thicknesses arranged in multiple alternating sequences of panels 520 of greater thickness and panels 510 of lesser thickness, such that the two different thicknesses may be 1.6 mm and 2.0 mm. Alternatively, as shown in FIG. 5B, the roof may include a multiplicity of horizontally continuous steel corrugated panels 550 of a single uniform thickness equal to or less than 1.6 mm in thickness.

Referring again to FIG. 5A, a roof panel stiffener assembly 530 may be provided supporting the roof and which is coupled to a door end beam 140A and extends longitudinally to a front end beam 140B. In one aspect of the embodiment, the roof panel stiffener assembly 530 may include two separate stiffeners abutting one another each including a flat longitudinal strip of metal with a multiplicity of tabs extending upwards perpendicularly at a ninety-degree angle from the flat longitudinal strip with the tabs of each of the separate stiffeners positioned adjacent to one another. In this regard, the assembly may include two symmetrical corrugated L stiffeners joined to one another. As well, two additional L stiffeners 540 may be disposed at opposite sides of the assembly 530 and may extend longitudinally from the door end beam 140A to the front end beam 140B.

Figure 6:
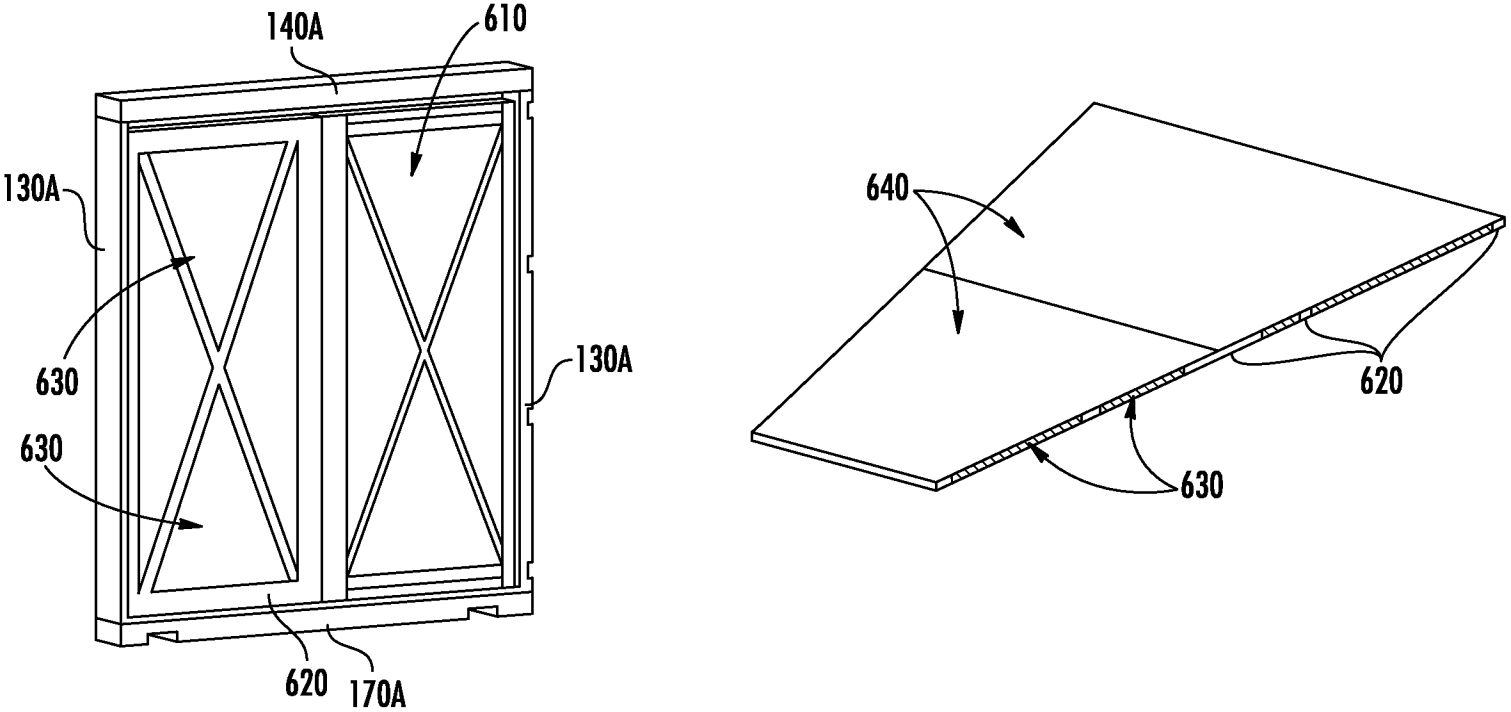
FIG. 6 is a perspective view of a door end assembly of the lightweight metallic container of FIG. 1 with an exploded portion illustrating a door of the container including at least one metallic cellular sandwich panel; and, FIG. 7 is a perspective view of a side wall of the lightweight metallic container of FIG. 1 with an exploded portion illustrating different stiffeners affixed to the top rail of each of the side panels.

A metallic cellular sandwich panel structure also may be incorporated into the door end assembly, though of a different thickness and frame than the floor. In even yet further illustration, FIG. 6 is a perspective view of a door end assembly of the lightweight metallic container of FIG. 1 with an exploded portion illustrating a door of the container including at least one metallic cellular sandwich panel. As shown in FIG. 6, the door end assembly is defined by the door end beam 140A and the door end posts 130A. Double doors 610 are hingedly affixed to the door end posts 130A, each of the double doors 610 including a frame 620 enveloping at least one metallic cellular sandwich core 630. The metallic cellular sandwich core 630 includes a multiplicity of arranged hollow polygonal cells formed of a metal such as aluminum, for instance with a thickness of forty-six millimeters. The frame 620 and the metallic cellular core 630 are covered by an aluminum skin 640. By utilizing the metallic cellular sandwich panel 610 instead of steel, a lighter weight door is provided that incorporates the strength provided by the metallic cellular sandwich structure without the weight of a solid material such as steel.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

We claim:

1. A lightweight metallic container comprising:

two parallel elongated side walls each having a top rail at one side and each being secured on an opposite side to a corresponding bottom rail of a floor frame, each bottom rail being coupled to one another by a floor secured to and resting on a multiplicity of cross-beam members of the floor frame, wherein the side walls each comprise a multiplicity of vertically continuous steel corrugated panels of two different thicknesses arranged in multiple alternating sequences of panels of greater thickness and panels of lesser thickness;

a front end assembly secured to one end of each of the top rails and to one end of each of the bottom rails over respective corner castings;

a door end assembly opposite the front end assembly and secured to an opposite end of each of the top rails and to an opposite end of each of the bottom side over respective corner castings, and a roof secured to respective ones of the top rails of each of the two side walls and comprising a multiplicity of horizontally continuous steel corrugated panels of a single uniform thickness of equal to or less than 1.6 mm in thickness, the floor comprising at least one metallic cellular sandwich panel formed by a frame defining an interior portion of the panel, the interior portion including a cellular core of a multiplicity of metallic polygonal cells, and a skin covering both the frame and the metallic cellular core.

2. The container of claim 1, wherein the two different thicknesses comprise 1.6 mm and 2.0 mm.

3. The container of claim 1, wherein the front end panel comprises a multiplicity of vertically continuous steel corrugated panels of two different thicknesses arranged in multiple alternating sequences of panels of greater thickness and panels of lesser thickness.

4. The container of claim 3, wherein the two different thicknesses comprise 1.6 mm and 2.0 mm.

5. The container of claim 1, wherein the roof comprises a multiplicity of horizontally continuous steel corrugated panels of two different thicknesses arranged in multiple alternating sequences of panels of greater thickness and panels of lesser thickness.

6. The container of claim 5, wherein the two different thicknesses comprise 1.6 mm and 2.0 mm.

7. The container of claim 5, further comprising a roof panel stiffener assembly supporting the roof and coupled to a door end beam and extending longitudinally to a front end beam.

8. The container of claim 1, further comprising a roof panel stiffener assembly supporting the roof and coupled to a door end beam and extending longitudinally to a front end beam.

9. The container of claim 7, wherein the assembly comprises two symmetrical corrugated L stiffeners joined to one another.

10. The container of claim 9, further comprising two additional L stiffeners disposed at opposite sides of the assembly and extending longitudinally from the door end beam to the front end beam.

11. The container of claim 1, wherein the bottom rail of each side wall comprises a multiplicity of stiffening ribs welded to the bottom rail.

12. The container of claim 1, wherein the top rail of each side wall comprises a pair of opposing stiffeners, one of the stiffeners extending horizontally from a top portion of the top rail upon which the roof rests, and a perpendicularly oriented one of the stiffeners extending downwardly from an interior side portion of the top rail outside of which one of the side panels rests.

13. The container of claim 1, wherein the door end assembly comprises two doors each comprising a frame defining an interior portion of the door, the interior portion including a metallic cellular core of a multiplicity of metallic polygonal cells, and an aluminum skin covering both the frame and the metallic cellular core.

* * * * *